United States Patent [19]

Jimenez

[11] Patent Number: 5,048,438

[45] Date of Patent: Sep. 17, 1991

[54] SEWING MACHINE BOBBIN THREAD TENSION CONTROL DEVICE

[75] Inventor: Antonio Jimenez, Meyrin, Switzerland

[73] Assignee: Mefina S.A., Fribourg, Switzerland

[21] Appl. No.: 439,468

[22] Filed: Nov. 21, 1989

[30] Foreign Application Priority Data

Nov. 29, 1988 [CH] Switzerland ..... 4431/88

[51] Int. Cl.[5] ..... D05B 47/00

[52] U.S. Cl. ..... 112/255; 112/184; 112/242

[58] Field of Search ..... 112/184, 191, 229, 242, 112/243, 254, 255, 302

[56] References Cited

U.S. PATENT DOCUMENTS

| | | | |
|---|---|---|---|
| 3,164,113 | 1/1965 | Ketterer | 112/242 |
| 3,467,039 | 9/1969 | Greenwood, Jr. et al. | 112/242 X |
| 4,182,250 | 1/1980 | Johnson | 112/184 |
| 4,215,639 | 8/1980 | Johnson | 112/242 |
| 4,399,761 | 8/1983 | Creed et al. | 112/242 |
| 4,437,421 | 3/1984 | Johnson | 112/184 X |

*Primary Examiner*—Werner H. Schroeder
*Assistant Examiner*—Paul C. Lewis
*Attorney, Agent, or Firm*—Young & Thompson

[57] ABSTRACT

The feed dog (17) for the fabric in a sewing machine is provided with a spring-wire (21) bent and passing through a hole of a support (23). When the feed dog (17) is in its upper position, the support (23) abuts the plate (18), which lowers the end (24) of the wire (21) so as to exert a tension on the lower thread (8) of the seam. When the feed dog is lowered, the wire (21) resumes its normal position, namely its end (24) is displaced upwardly with respect to the dog (17) and the thread (8) is thus relaxed.

8 Claims, 1 Drawing Sheet

SEWING MACHINE BOBBIN THREAD TENSION CONTROL DEVICE

BACKGROUND OF THE INVENTION

There are already known sewing machines comprising a needle bar and means for imparting reciprocating longitudinal movements thereto, means for securing a needle on this bar and supplying thread to this needle, a loop holder for taking hold of the thread introduced by the needle and causing it to pass around a shuttle spool whose thread thus passes through this loop so as to form a seam stitch, a mechanical transporter for displacing the fabric to be sewn from one completed seam stitch to the following point to be sewn, means being provided for slackening the thread issuing from the spool, at the time of each seam stitch formation.

OBJECT OF THE INVENTION

The invention has as an object a sewing machine of the above-described type, in which other means are provided for relaxing the lower thread, which means permit attaining greater efficiency in a simpler manner. To this end, the machine comprises an element actuated by the transporter mechanism for relaxing the thread from the spool at the time of each cycle of the transporter mechanism.

BRIEF DESCRIPTION OF THE DRAWING

The accompanying drawings shows the schematically and by way of example, an embodiment and a variant thereof of the machine according to the invention.

DETAILED DESCRIPTION OF THE INVENTION

Figure 1:
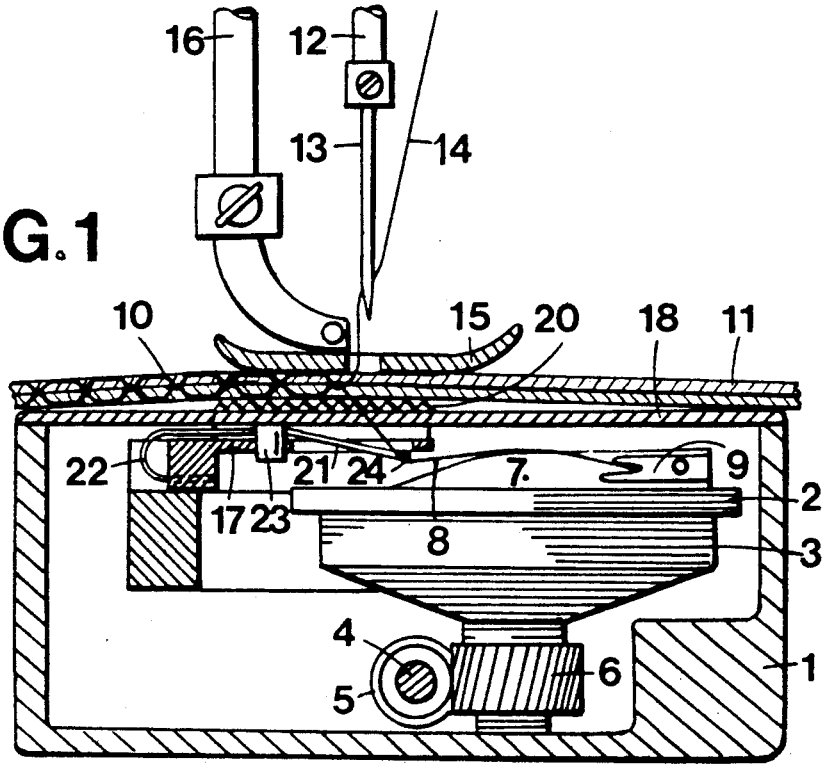
FIG. 1 is a transverse sectional view of the lower arm of a sewing machine, showing part of the transporter mechanism and loop holder according to this embodiment.

Referring to FIG. 1 the lower arm 1 of a sewing machine is hollow and contains a loop holder forming part of a reservoir 3 driven in rotation by a motor shaft 4 bearing a tangential threading 5 meshing with a tooth wheel 6 fixed to the reservoir 3.

The reservoir 3 contains a thread bobbin or spool, not shown, which is carried in a casing 7, retained by well known means so as not to be driven in rotation by the reservoir 3.

The thread 8 issuing from the shuttle spool passes beneath a tension spring 9 to supply the stitching 10 for fabrics 11.

The machine comprises in a conventional manner a needle bar 12 provided with a needle 13, through the eye of which passes the upper thread 14. The machine also comprises a presser foot 15 pressed against the fabric by a rod 16 subjected to the action of a spring not shown.

The successive displacements of the fabric during the stitching are caused by a feed dog 17 forming part of a transporter mechanism not shown, as these mechanisms have been known for a very long time in this art.

Figure 3:
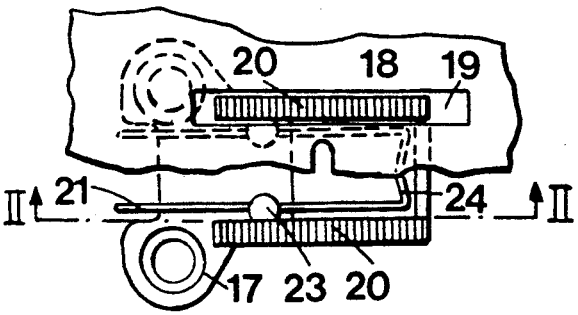
FIG. 3 is a view from above of the feed dog of the transporter.

This feed dog 17 is situated beneath a throat plate 18, which, as shown in FIG. 3, has two slots 19, only one of which is visible in the drawing, for permitting the passage of two toothed portions 20 of the dog 17.

This dog 17 is provided with an element intended to relax the thread of the shuttle spool, at the time of each cycle of the transporter mechanism. This element is constituted by a generally U-shaped elastic steel wire 21, at the rear end of which the arms are curved at 22 so as to be received in a part of the dog 17.

Each of the arms of the U-shaped member passes through a bore in a support 23, which is slidable in a vertical portion of the dog 17. At the time of the displacement of the dog upwardly, so as to take hold against the fabric to be stitched, each support 23 abuts against the throat plate 18, as shown in FIG. 1, which downwardly deforms the steel wire 21, thus exerting a tension on the thread 8.

Figure 2:
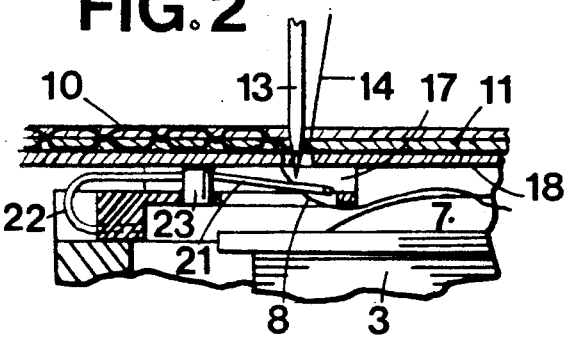
FIG. 2 is a partial sectional view of FIG. 1, in which the feed dog of the transporter occupies another position, along the line II—II of FIG. 3.

When the transporter mechanism displaces the dog 17 downwardly, the steel wire 21 resumes its initial position and takes the position illustrated in FIG. 2, in which it no longer exerts a tension on the lower thread 8.

The thread is thus relaxed, as shown in FIG. 2, which facilitates the pulling of the lower thread into the materials to be stitched, under the effect of the traction exerted by the upper thread 14, regardless of the stitching speed. It should be noted that the length of the thread which is relaxed at each cycle is a function of the horizontal distance traversed by the dog while the steel wire 21 acts on the thread 8. There is thus obtained a slack which substantially increases as a function of the length of the selected stitch.

Figure 4:
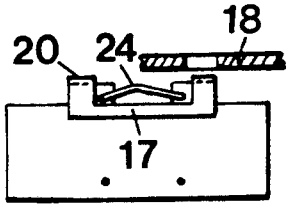
FIG. 4 is an end view of the feed dog.

As shown in FIGS. 3 and 4, the transverse portion 24 of the steel wire 21 has a bent shape which is intended to cause the extent of the slack to vary as a function of the lateral position of the thread 8 in the case where the machine is adapted to perform zig-zag stitching.

It is clear that the bent shape of the steel wire must be adapted as a function of the general shape of the machine, especially from the departure position of the lower thread 8 when it leaves the support 9 with respect to the position of this thread in the stitching 10.

Figure 5:
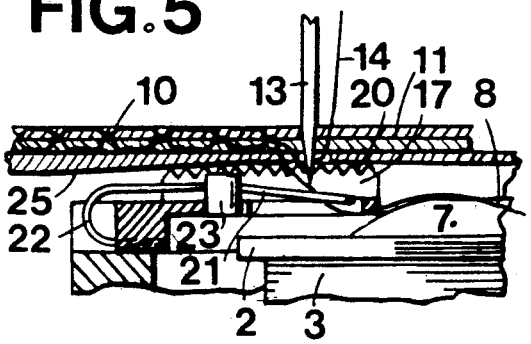
FIG. 5 is a section substantially similar to that of FIG. 2 and illustrating the second embodiment.

In the modification shown in FIG. 5, the throat plate 18 has been replaced by a throat plate 25 whose lower face is inclined to form a ramp. In this manner, the deflection of the wire 21 depends on the longitudinal position of the feed dog 17 of the transporter and consequently, of the length of the stitches selected for the seam.

In this manner, it is possible to give still more slack to the lower thread 8, for a seam having a large stitch length, as compared with a seam having short stitches.

It is evident that a similar effect could be obtained by causing the steel wire, or a similar member such as a lever, to cooperate with an adjustable abutment whose position could be determined by an individually controlled mechanism, or associated with a conventional device for controlling the length of the advancing interval of the transporter.

According to another interesting variation, there could be obtained an oblique position of the central portion of the steel wire with respect to the horizontal, so as to take account of lateral displacements of the needle when effecting a zig-zag stitch, by providing a difference between the two blocks, for example a difference in the distance between the top of the block and the bore in which the thread 21 passes. A similar effect could be obtained by providing a throat plate having different bearing levels for the two blocks. These two latter could moreover be replaced by a transverse pin connecting the two parallel arms of the U-shaped member.

I claim:

1. Sewing machine comprising a longitudinally reciprocable needle bar, means for securing a needle on this bar, a loop holder for taking hold of an upper thread introduced by the needle and cause said upper thread to pass around a spool having a lower thread thereon so as to form a seam stitch, a transporter mechanism for displacing fabric to be sewn from a completed seam stitch to a following point to be stitched, means for slackening the lower thread prior to the formation of each seam stitch, an element actuated by the transporter mechanism for said fabric to be sewn, so as to relax the lower thread issuing from the spool once during each cycle of the transporter mechanism, the transporter mechanism comprising a vertically movable feed dog, said element being mounted on the feed dog of the transporter mechanism and cooperating with a stationary abutment upon vertical movement of the feed dog to relax the lower thread.

2. Machine according to claim 1, wherein the element includes an elastic steel wire deformable upon contact of said element with the abutment.

3. Machine according to claim 2, wherein the steel wire has at least one support so disposed as to cooperate with the abutment.

4. Machine according to claim 3, wherein the abutment is formed by a ramp extending in the direction of movement of transporter, so as to obtain an elastic deformation of the steel wire as a function of a length of a period of the transporter.

5. Machine according to claim 1, having means for displacing the needle laterally, especially for effecting zig-zag seams, wherein said element has a portion extending transversely of the thread issuing from the spool, the transverse portion being adapted to vary a length of the thread which is relaxed, as a function of a lateral position of the needle.

6. Machine according to claim 1, having means for displacing the needle laterally, especially for effective zig-zag seams, wherein said element has a portion extending transversely of the lower thread issuing from the spool, and means for deforming the transverse portion at each cycle of the feed dog, to vary a length of the lower thread which is relaxed, as a function of a lateral position of the needle.

7. Machine according to claim 1, wherein the abutment is constituted by a lower surface of a throat plate covering the transporter mechanism.

8. Machine according to claim 1, further including a throat plate having an inclined undersurface against which said element bears in a raised position of the feed dog, whereby a vertical position of said element depends on a longitudinal position of the feed dog.

* * * * *